United States Patent [19]

Abts et al.

[11] 4,329,949

[45] May 18, 1982

[54] CYLINDER HEAD FOR AN INTERNAL-COMBUSTION ENGINE

[75] Inventors: Manfred Abts, Odenthal-Hahnenberg; Dieter Urban, Pulheim-Sinnersdorf, both of Fed. Rep. of Germany

[73] Assignee: Ford Motor Company, Dearborn, Mich.

[21] Appl. No.: 164,722

[22] Filed: Jun. 30, 1980

[51] Int. Cl.[3] ..... F01M 9/10

[52] U.S. Cl. ..... 123/90.34; 123/196 V; 184/6.9

[58] Field of Search ..... 123/90.33, 196 V, 90.34, 123/90.27; 184/6.5, 6.6, 6.7, 6.8, 6.9

[56] References Cited

U.S. PATENT DOCUMENTS

| | | | |
|---|---|---|---|
| 2,758,580 | 8/1956 | Balzer | 123/90.34 |
| 3,164,143 | 1/1965 | Dolza | 123/195 R |
| 3,628,513 | 12/1971 | Grossean | 123/90.34 |

*Primary Examiner*—Charles J. Myhre
*Assistant Examiner*—E. Rollins Cross
*Attorney, Agent, or Firm*—Robert E. McCollum; Clifford L. Sadler

[57] ABSTRACT

A cylinder head for an automotive type engine has an overhead camshaft and oil collecting basins adjacent the tappet guides to collect excess oil exuded from the guides; the basins have holes aligned with the cams on the camshaft to drip oil thereon for proper camshaft lubrication; inserts may be used in the oil drip holes, or specially formed drip edges adjacent the holes may be used.

6 Claims, 5 Drawing Figures

1
1
1
6
7
14
15
16
16
16
18
18
18'
19
19'
20
20'
21
22
23
2
3
24
24'

CYLINDER HEAD FOR AN INTERNAL-COMBUSTION ENGINE

The invention relates to a cylinder head for an internal combustion engine of the type having a hermispherically or dome-shaped combustion chamber with intake and exhaust valves arranged approximately radially to its surface. The valves are operable by sheet metal rocker arms actuated by tappets engaged directly with the cams of an overhead camshaft. The camshaft is arranged symetrically between the intake and exhaust valve trains. Bridges span the camshaft adjacent to the camshaft bearing webs, and are formed from the cylinder head projections or bosses that accommodate the valve stem guides, the rocker arm stud mounting holes, and the tappet guides.

A cylinder head of the type broadly described above is shown and described in U.S. Pat. No. 3,164,143. In the patent, the area of the cylinder head extending beneath the camshaft is of a tank-shaped construction. This permits excess lubricating oil that runs off from the tappet guides, which generally are supplied with an excess of lubricating oil under pressure, to accumulate, forming a lubricating oil sump for the camshaft. The usual drainage orifices from this lubricating oil sump are located to provide an oil level build up that will assure the cam surfaces of the camshaft being wetted by the dip lubrication method. Lubrication of the rocker arm bearing pieces, therefore, in the patent is intended to be achieved by the splash oil occurring in the valve gear space.

In an internal combustion engine, if hydraulic valve tappets are adopted, which automatically compensate for play in the valve gear, then it is important to control the amount of air that is added to the lubricating oil delivered by the oil pump to the engine.

The lubrication of the valve gear of an internal combustion engine by pressure lubrication and dip and splash lubrication hitherto practiced leads inevitably to higher proportions of air in the lubricating oil. This results either in an impairment of effectiveness of the hydraulic valve tappets or, alternatively, the adoption of onerous measures to calm the lubricating oil.

It is an object of the invention to provide an improved construction of a cylinder head for an internal combustion engine of the type initially defined so that the hitherto customary dip and splash lubrication of parts of the valve gear of the internal combustion engine can be eliminated. The invention provides oil collector basins adjacent each of the tappet guides to collect the lubricating oil exuding from the guides and discharge it through oil drainage holes aligned with portions of the corresponding cams of the camshaft. This achieves very reliable lubrication of the camshaft and furthermore reduces to a minimum the inclusion of air in the lubricating oil.

As a modification, spout-like inserts may be pressed into the oil drainage holes, the inserts consisting of thin walled tubes so that the ends constitute in effect sharp edges to ensure an aimed dripping of the lubricating oil onto the corresponding cams of the camshaft.

Other features include lubricating oil channels connected from the tappet guides to those sections of the rocker arm stud mounting bores located above the screwthreads, radial lubricating oil grooves on the rocker arm fulcrum bearing surface loaded by the nut, and lubrication of the rocker arm lower bearing surface while avoiding oil splashes that cause air inclusions. Also, the area in the cylinder head that lies beneath the camshaft communicates by lubricating oil drainage orifices with oil return channels, and, therefore, eliminates the need for a camshaft lubricating oil sump.

Other objects, features and advantages of the invention will become more apparent upon reference to the succeeding, detailed description thereof, and to the drawings illustrating the preferred embodiments thereof; wherein, FIG. 1 is a plan view of an internal combustion engine cylinder head embodying the invention;

Figure 1:
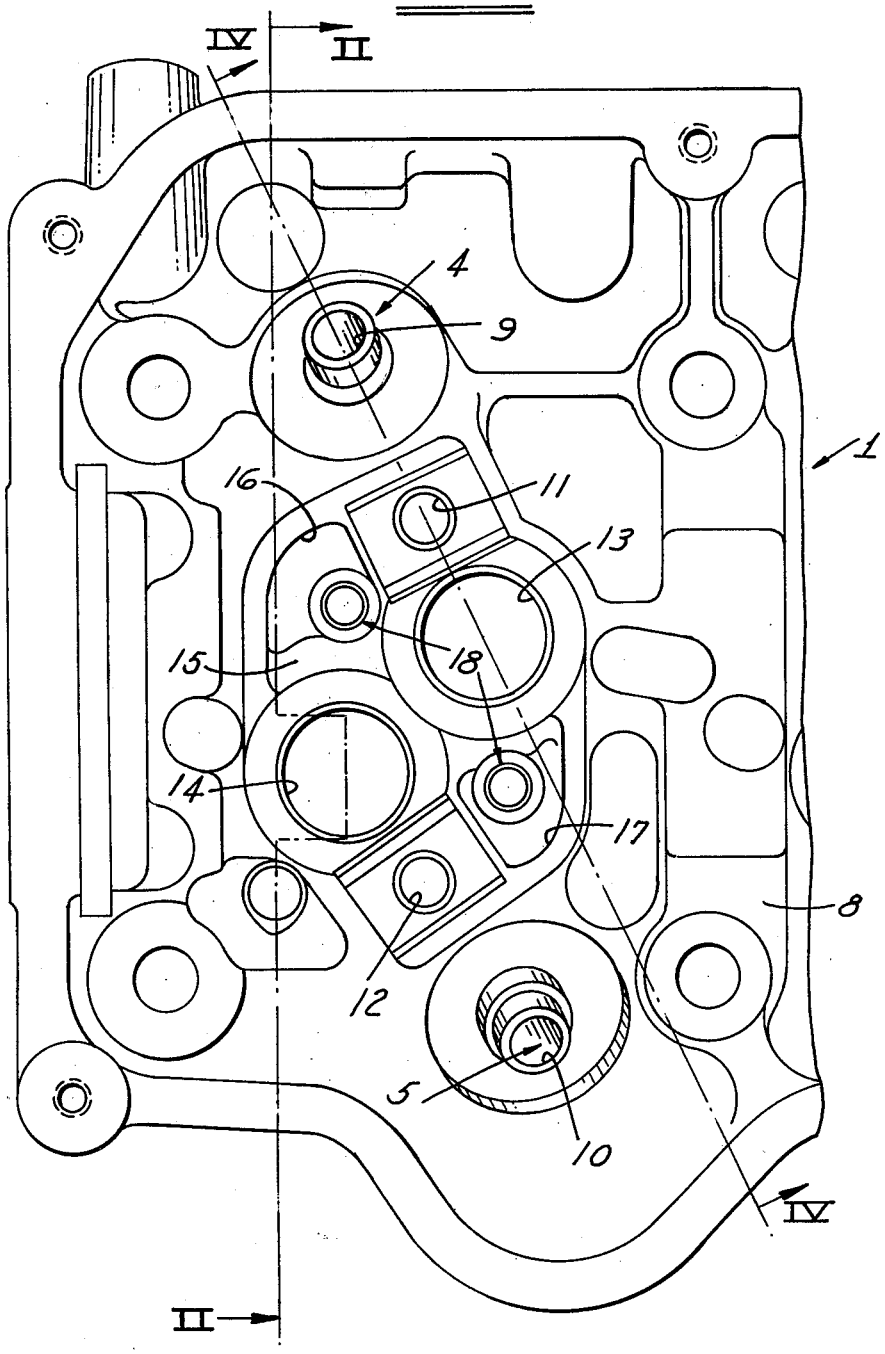
Figures 2, 3, 3A:
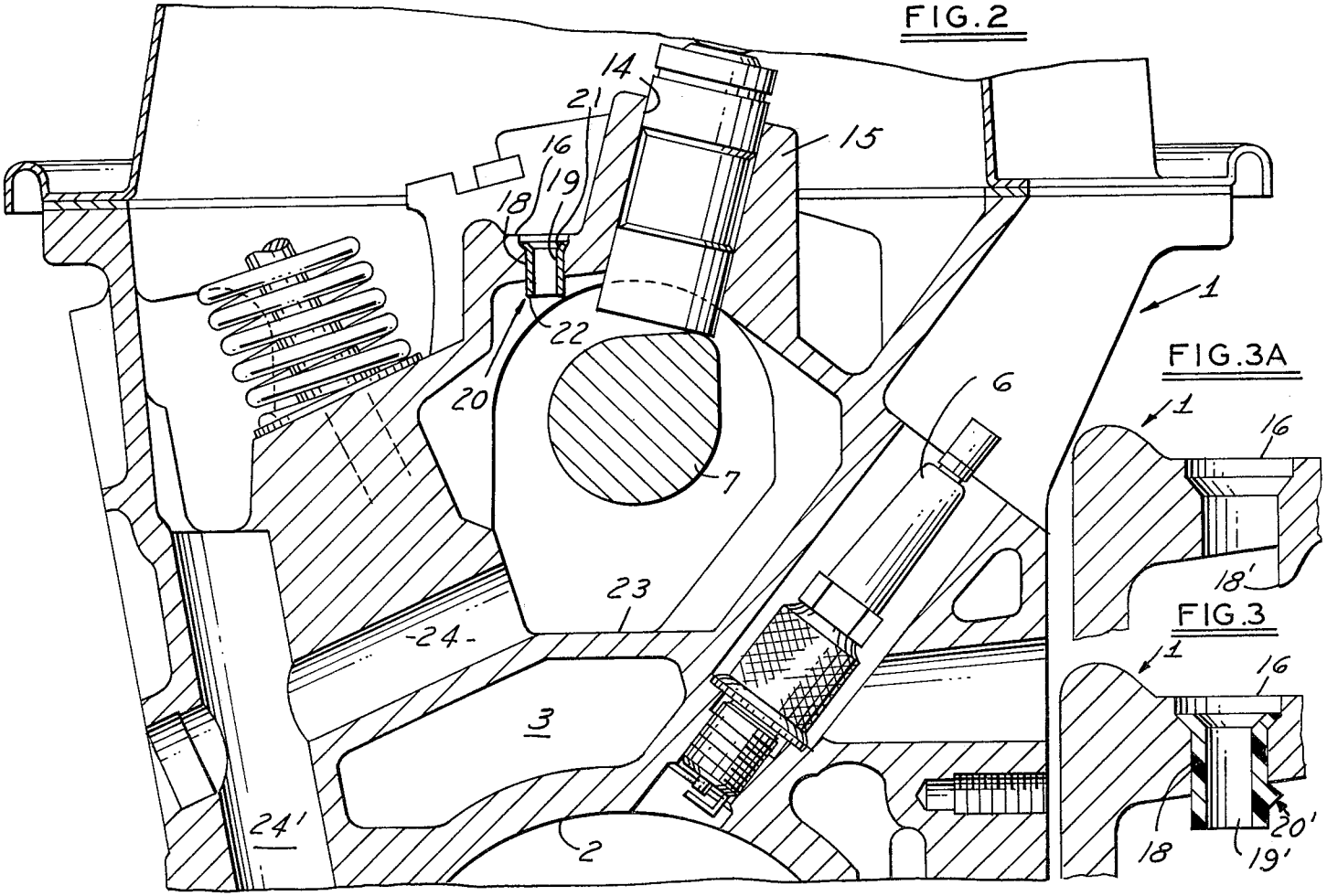
FIG. 2 is a vertical cross-sectional view made along the line II—II in FIG. 1.
FIG. 3 is an enlarged cross-sectional view of a detail of FIG. 2.
Figure 4:
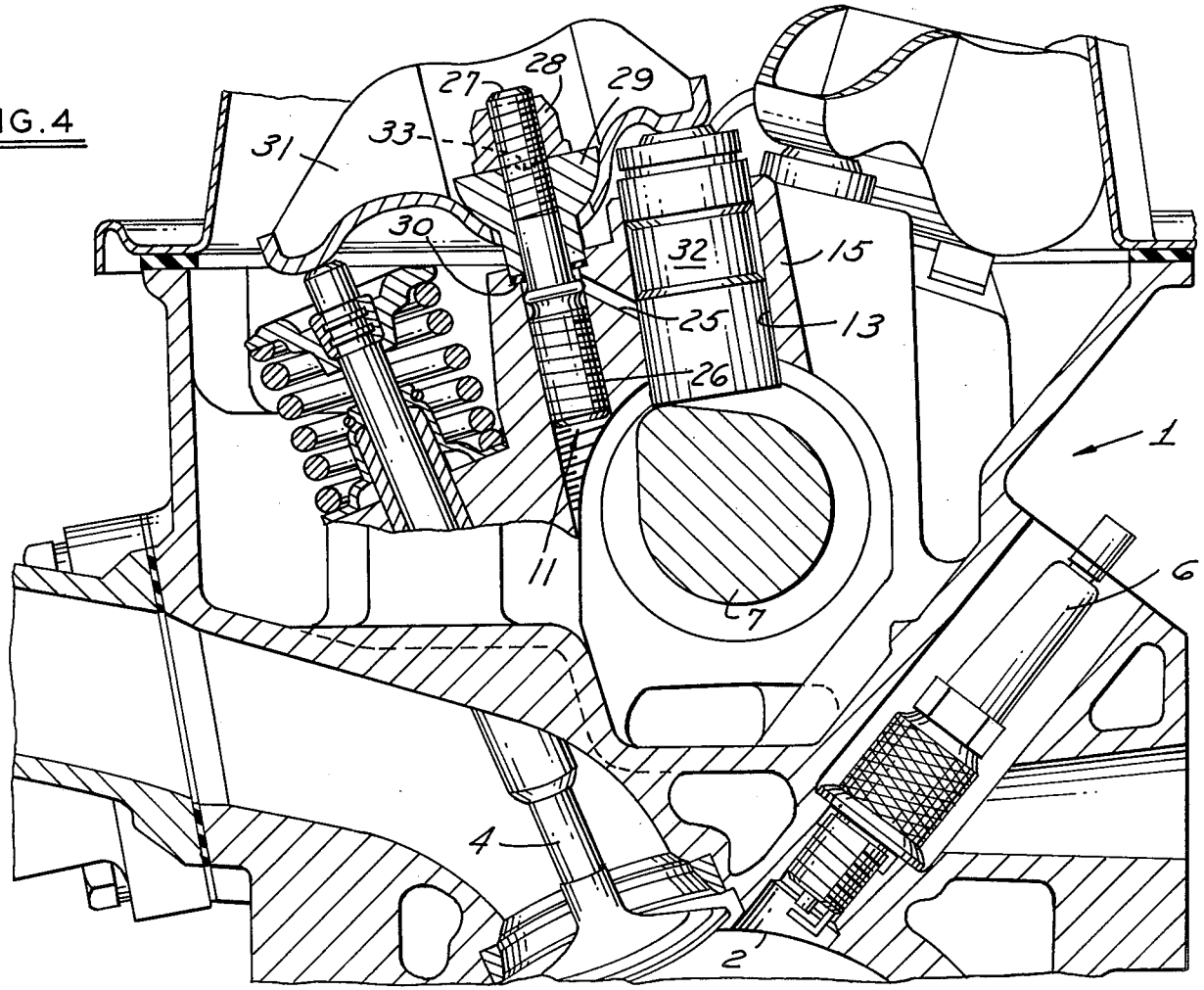

FIG. 3*a* is a cross-sectional view of a modification of the FIG. 2 showing; and FIG. 4 is a vertical cross-sectional view made along the line III—III in FIG. 1.

FIGS. 1 and/or 2 illustrate a cylinder head 1 for an internal combustion engine that is formed with a hemispherically or dome-shaped combustion chamber 2, mutually communicating cooling medium spaces 3, intake and exhaust passages (only partly shown) located between the cooling spaces and controlled by intake and exhaust valves 4 and 5, respectively, and a spark plug bore accommodating a spark plug 6.

An overhead mounted crankshaft 7 extends parallel to the longitudinal direction or axis of the internal combustion engine and is rotatably mounted in a plurality of camshaft bearing webs 8 (FIG. 1). Adjacent to the camshaft bearing webs 8 are formed bridges 15 that span the camshaft 7 and extend from the bosses or projections that accommodate the valve stem guides 9 and 10, the rocker arm fulcrum mounting stud bores 11 and 12, and the tappet guides 13 and 14.

Formed in the bridges 15 adjacent each of the tappet guides 13 and 14 are oil collector basins 16 and 17. The latter collect the excess lubricating oil that normally is exuded from the tappet guides 13 and 14 during reciprocation of the tappets. The tappets are supplied with oil from an oil pump, not shown, in a known manner. This oil from the tappet guides is discharged through oil discharge holes 18 (FIG. 3) formed in each of the basins and vertically aligned with portions of the corresponding cams on the camshaft 7. Pressed into the oil discharge bores 18 may be oil passage inserts 19 that consist of a thin sheet metal tube or the like, the ends 22 of which project beyond the bottom wall of the bridge member. This ensures an aimed dripping of the lubricating oil onto the corresponding cams of the camshaft 7.

The oil passage inserts 19 in this case may be constructed as a polygonal tube, for example, and have flared or funnel-like conical portions 21 at their upper ends and drip lip type edges 22 at their lower ends.

FIGS. 1 and 2 show that lubricating oil exuding from the top of the tappet guide bore 14 will run down the outsides of the cylinder head boss and accumulate in the oil collector basins 16 and 17. From there, it can drip through the oil passage inserts 19 onto the cams of the revolving camshaft 7. It will also be seen that the open area 23 extending beneath the camshaft 7 returns the lubricating oil in this area to the crankcase (not shown) through connecting lubricating oil return channels 24 and 24'.

An alternate construction of the invention is shown in FIG. 3*a* in which a molded drip lip 18' is integrally shaped in the casting of the cylinder head in a manner to intersect the adjacent oil discharge bore 18 and thus form a drip edge. It is likewise possible to produce the oil passage inserts 19' (FIG. 3) from a plastics material, in which case the inserts can be prevented from accidental falling out of or being displaced from the oil discharge bores 18 by one or more flexible retaining lips 20'.

FIG. 4 illustrates a further feature of a cylinder head constructed according to the invention. In this case, the bore communicates with a lubricating oil channel 25 that connects to the screw-thread portion of the bore 26 in which is mounted the rocker arm fulcrum supporting stud 27. The stud 27 screwed into bore 11 tensions, through a nut 28, the semi-cylindrical rocker arm bearing piece or fulcrum 29 against a step or offset 30 of the bore. Biased or forced against the rocker arm bearing piece 29 is a sheet metal rocker arm 31, one end of which is engaged by a hydraulic tappet 32, and the other end bearing against the stem of the valve 4. The lubrication of the semi-cylindrical surfaces between the rocker arm fulcrum 29 and the corresponding bushing in the sheet metal rocker arm 31 is particularly essential and is ensured according to the invention by radial lubricating oil grooves 33 in the plane surface of the rocker arm fulcrum 29 at the point loaded by the nut 28. Due to the loading of the bore 11 of the stud 27 with lubricating oil under pressure, lubricating oil can climb up the central bore of the rocker arm bearing piece 29 and be guided at the nut 28 through the radial lubricating oil grooves 33 to the lateral portions of the rocker arm 31, from where it passes onto the bushing surfaces of the rocker arm 31.

From the foregoing, it will be seen that components of the valve gear of the internal combustion engine are adequately lubricated by specific measures so that the hitherto customary dip lubrication or oil splash lubrication method of lubrication can be abandoned, which will result in lubricating oil in the entire lubricating oil circuit of the internal combustion engine being kept as free as possible from air inclusions.

While the invention has been shown and described in its preferred embodiments, it will be clear to those skilled in the arts to which it pertains that many changes and modifications may be made thereto without departing from the scope of the invention.

We claim:

1. A cylinder head for an internal combustion engine having a dome-shaped combustion chamber with intake and exhaust valves arranged approximately radial to the surface of the chamber and symetrically located on opposite sides of a single overhead camshaft for individual actuation by one end of a rocker arm that is pivotally mounted to the head by a stud, the rocker arm being operably engaged at its opposite end by a tappet movable by the camshaft, and bridge members spanning the camshaft and providing mounting bores for the studs, and providing tappet guides slidably accommodating the tappets therein, the tappet guides receiving lubricating oil therein that is exuded from the guides during movement of the tappet by the camshaft, characterized by, an oil collecting basin adjacent a tappet guide for collecting oil exuded therefrom, the basin having a discharge hole therein vertically aligned with a portion of a cam on the camshaft so as to drip oil on the cam to lubricate the cam.

2. A cylinder head according to claim 1, characterized in that on the underside of the oil collector basin adjacent the hole the cylinder head is formed with a drip edge onto which the oil flows to ensure an aimed dripping of the lubricating oil onto a cam of the camshaft.

3. A cylinder head according to claims 1 or 2, characterized in that the oil discharge hole receives therein a tubular insert defining an oil passage and having a flared upper end constructed as a conical funnel, and a lower edge constructed as a drip edge projecting out beyond the lower wall of the bridge member to ensure an aimed dripping of the lubricating oil onto a cam of the camshaft.

4. A cylinder head according to claims 1 or 2, characterized in that the oil discharge hole receives therein an insert defining an oil passage that is secured against accidental withdrawal from the hole by a retaining lip, one end of the insert being formed to ensure an aimed dripping of the lubricating oil onto a cam of the camshaft.

5. A cylinder head according to claims 1 or 2 including a lubricating oil channel connecting the tappet guide oil to a portion of the stud bore for lubricating the same, and the pivotal mounting of the rocker arm to the stud including fulcrum means, and a nut securing the fulcrum means to the stud, and a radial lubricating oil groove connecting the stud bore to the surface of the fulcrum means loaded by the nut.

6. A cylinder head according to claims 1 or 2, characterized in that the portion of the head extending beneath the camshaft communicates through lubricating oil discharge orifices with a lubricating oil return channel removing the oil therein to other parts of the engine.

* * * * *